US005095333A

United States Patent [19]

Shimada

[11] Patent Number: 5,095,333

[45] Date of Patent: Mar. 10, 1992

[54] IMAGE RECORDING APPARATUS WITH COOLING FAN

[75] Inventor: Takeichi Shimada, Hachioji, Japan

[73] Assignee: Konica Corporation, Tokyo, Japan

[21] Appl. No.: 528,939

[22] Filed: May 25, 1990

[30] Foreign Application Priority Data

May 29, 1989 [JP] Japan ..... 1-132710
May 29, 1989 [JP] Japan ..... 1-132711

[51] Int. Cl.[5] ..... G03G 21/00
[52] U.S. Cl. ..... 355/208; 236/49.3
[58] Field of Search ..... 355/30, 207, 208, 210, 355/215; 174/15.1; 236/49.3; 361/383, 384

[56] References Cited

U.S. PATENT DOCUMENTS 4,817,865 4/1989 Wray ..... 236/49.3
4,903,072 2/1990 Iwata ..... 355/30
5,027,611 7/1991 Doi et al. ..... 236/49.3

FOREIGN PATENT DOCUMENTS 0116956 5/1987 Japan ..... 355/30
0209458 8/1989 Japan ..... 355/30

*Primary Examiner*—A. T. Grimley
*Assistant Examiner*—P. Stanzione
*Attorney, Agent, or Firm*—Jordan B. Bierman

[57] ABSTRACT

The invention provides an image recording apparatus with cooling fan. Namely, the apparatus comprises copying device for forming toner image and transferring the toner image on a copy sheet; a cooling fan for cooling the copying device; and control device for operating the cooling fan. The control device includes a memory for storing a reference data with respect to recording condition of the copying device, and detector for obtaining data of current recording condition of the copying device, whereby the control device compares the obtained data with the stored reference data. In accordance with this comparison, the control device operates the cooling fan.

1 Claim, 4 Drawing Sheets

IMAGE RECORDING APPARATUS WITH COOLING FAN

BACKGROUND OF THE INVENTION

The present invention relates to an image recording apparatus and more particularly, to an image recording apparatus having an improved drive control of a cooling fan for least quiet cooling operation.

In a copying machine of electrostatic recording method, its image recording section is constructed as shown in FIG. 3. A charging electrode 1 charges a high voltage onto a surface of a conductive sensitizing body (photoreceptor) 2. If an image light 3 carrying image information coming in while the sensitizing body 2 is revolving in the direction of arrow a, the charge of the sensitizing body 2 changes. An electrostatic latent image, then, is formed there. The latent image is developed by a developing unit 4 to a toner image. On the other hand, a copying sheet 8 that has be fed to a registration roller 7 from a paper feeder section 5 by a sheet feeding roller 6, is re-fed from the registration roller 7 to a copying electrode 9 at a time when the copying sheet 8 matches with a beginning of the toner image. The toner image, then, can be copied onto the copying sheet 8. The copying is made in a way that a potential higher than that of the sensitizing body 2 is applied to the copying electrode 9. The copying sheet 8 on which the toner image has been copied is separated from the sensitizing body 2 by a separation electrode 10, and is carried to a thermal setting unit (fixing unit) 11. The thermal setting unit 11 has a heating roller 11A comprising an aluminum cylinder having a heater therein, have a pressure roller comprising a rubber roller inside there.

The image recording apparatus having such an thermal setting unit 11 incorporated therein produces some heat therein, which causes some difficulties. It therefore has a cooling fan 12 for air exhaustion.

In the conventional technique, the cooling fan 12 is controlled to operate at cyclic timings as shown in FIG. 6. In the cyclic operation, with power being on, a low-speed exhaustion, or idling, starts. When copying is started thereafter, it is switched over to a high-speed exhaustion. With end of copying, the operation is reset to the low-speed exhaustion again.

In the conventional operation, this is always set in the high-speed exhaustion state with start of copying. This involves a loud operation sound, which prevents quiet office works.

SUMMARY OF THE INVENTION

An object of the present invention is to provide an image recording apparatus that can minimize or make low a cooling fan operation except for necessary to realize a quiet operation as low as possible.

An image recording apparatus of the present invention has a cooling fan, wherein it has control means that can switch over the cooling fan from a low-speed exhaustion operation to a high-speed exhaustion operation when a set number of copying sheets exceeds a reference number.

The control means can be replaced by a means that can switch over from "ON" to "OFF" the cooling fan when the set number of copying sheets exceeds the reference number.

The reference number can be made smaller for a large size of copying sheets.

The reference number can be selected within a range of one to five sheets.

The image recording apparatus of the present invention has an advantage that its operation can be quiet as it exhaust air at the high speed in the time when large number of copy sheets are required.

According to another embodiment of the present invention, the above-mentioned object can be achieved by a following image recording apparatus with a cooling fan. The image recording apparatus comprises a first counting means for measuring a time from start of recording operation, a second counting means for measuring a time from end of preceding recording operation to start of present recording operation, and a control means that can switch over the cooling fan from a low speed to high at the time when the first counting means has counted a first reference time and that can switch over the cooling fan from the low speed to high at the same time as the start of recording operation when a counted result of the second counting means has not exceeded a second reference time or that can remain the cooling fan at the low speed when the counted result has exceeded the second reference time.

The above-mentioned control means may be replaced by an alternative control means that can start the cooling fan at the time when the first counting means has measured the first reference time and that can switch over the cooling fan from the low speed to high at the same time as the start of recording operation when the counted result of the second counting means has not exceed the second reference time or that can remain the cooling fan at the low speed when the counted result has exceed the second reference time.

According to this embodiment of the present invention, as described above, it has an advantage that its operation can be quiet in the way that if the time from end of the preceding copying to start of the present copying is rather longer, exhaustion or high-speed exhaustion is not made at the same time as the start of copying, and that if the exhaustion or high-speed exhaustion is not made even when copying is restarted, the exhaustion or high-speed exhaustion is made after the preset time elapses.

BRIEF DESCRIPTION OF THE DRAWINGS

The features and advantages of the invention will be understood by reference to the following drawings.

In the drawings.

DETAILED DESCRIPTION OF THE REFERRED EMBODIMENTS

Figure 1:
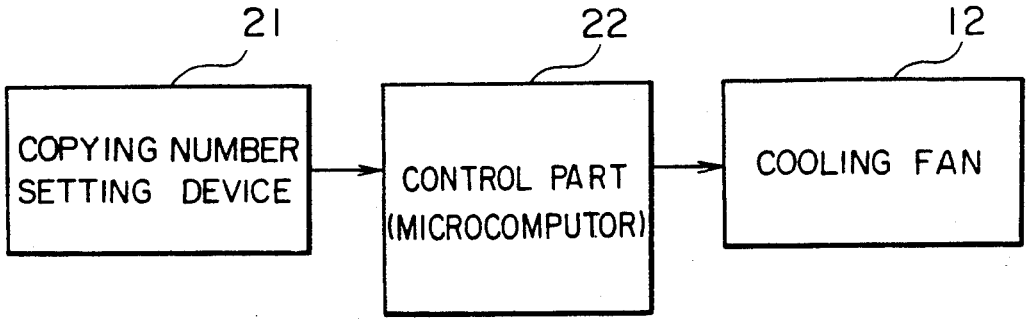
FIG. 1 is a block diagram for a cooling fan control circuit of a preferred embodiment of an image recording apparatus with cooling fan according to the present invention.
Figure 2:
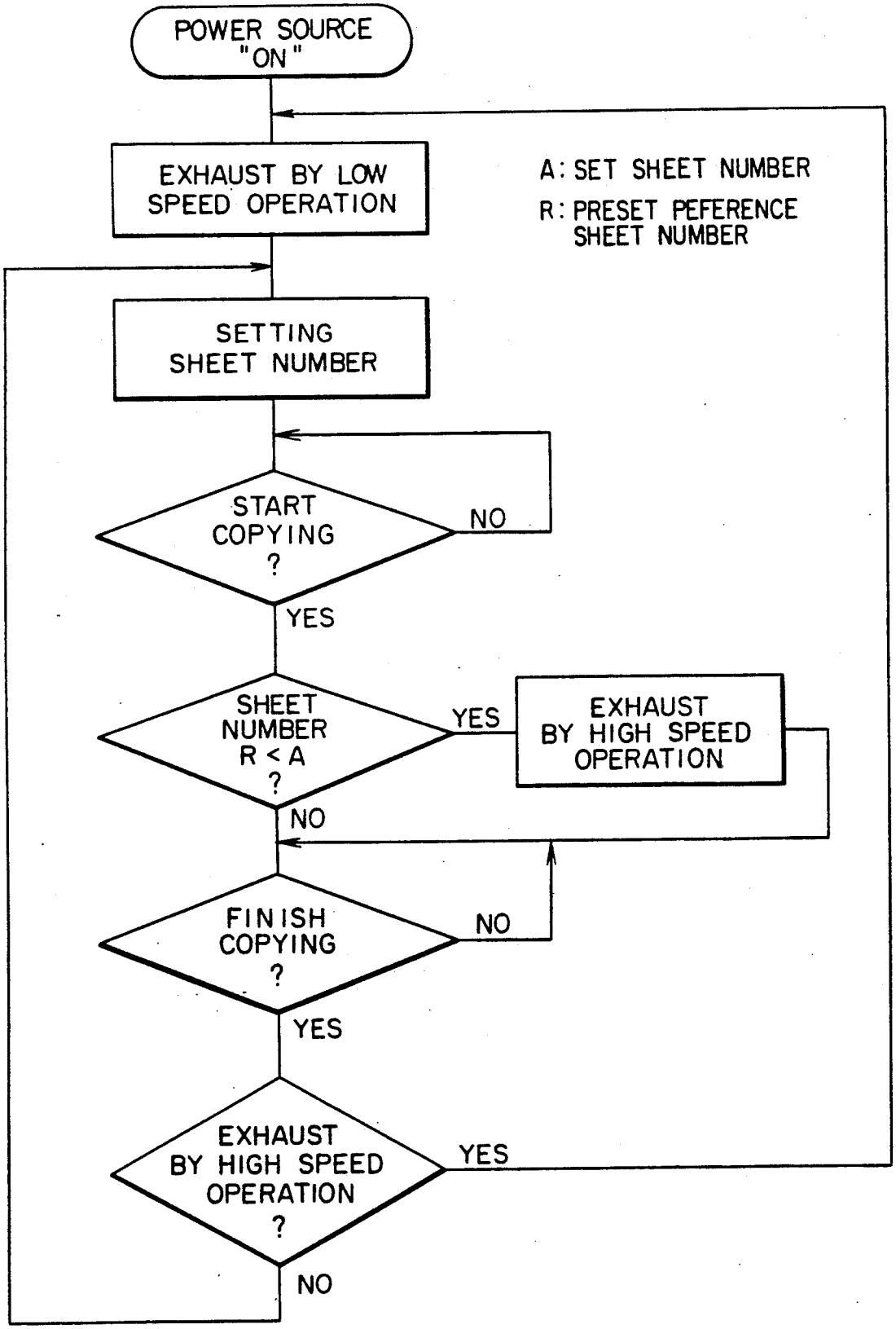
FIG. 2 is a flow chart of a program for controlling the cooling fan in FIG. 1.

Referring now to the figures, embodiments of the image recording apparatus with cooling fan of the present invention will be described below. FIG. 1 is a block diagram for a cooling fan of an embodiment of the present invention. FIG. 2 is a flow chart for a control program for the cooling fan 12. In the embodiment, a set data of number of copying sheets from a copying number setting device 21 is fetched as a current recording condition into a control section 22 comprising a microcomputer. Depending on a set number A of copying sheets, the cooling fan 12 is switched to a low-speed exhaustion or a high-speed exhaustion.

Referring now to FIG. 2, operation and control of the cooling fan 12 will be described below. First, with power being on, the cooling fan 12 can starts the low-speed exhaustion, and enters a normal idling operation. This can normally exhaust air from a recording unit enclosure. Then, the number of copying sheets can be accepted to set, and copying starts. It is determined whether the set number A is more or less than a preset reference number R as a reference data with respect to recording condition. The reference number R, for example, is preset within a range one to five sheets. If the set number A is within the preset reference number R, the low-speed exhaustion will continue until end of copying. This can make copying operation rather quiet. If the set number A is more than the preset reference number R, then the low-speed exhaustion stage is switched to the high-speed exhaustion stage, which continues until copying ends. If the cooling fan 12 is in the high-speed exhaustion stage at the end of copying, it is switched over to the low-speed exhaustion stage, and stands by until a next number of copying sheets is set.

If a large size of sheets is used for copying, a thermal setting section will absorb a larger amount of heat. A heater temperature of a heating roller 11A, then, is controlled at a high temperature. This results in an increase of the internal temperature. The preset reference number R should be determined in terms of an additional factor of size of sheets.

The determination of the reference number R can be made in a way that the data of size of copying sheets selected is fetched into the control circuit 22. If a large size of copying sheets (for example, A3 or B4), the control circuit 22 can correct the reference number R to a number smaller than the original one. This allows the high-speed exhaustion even for the smaller set number of copying sheets.

In the above-mentioned embodiment is described the two-stage switching of low and high speed exhaustions by the cooling fan 12. The present invention can also apply to only on-off control of the cooling fan 12. In this case, the above-mentioned "low-speed exhaustion state" can be replaced by an off-state of the cooling fan 12, and the "high-speed exhaustion state" by an onstate.

Incidentally, in the case where there is provided a counter for counting a number B of copied sheets, the number B can be used as a current recording condition instead of the set number A.

As seen from the above description, the image recording apparatus of the present invention has an advantage that its operation can be quiet as it exhausts air at the high speed when a large number of copying sheets are required.

Figure 4:
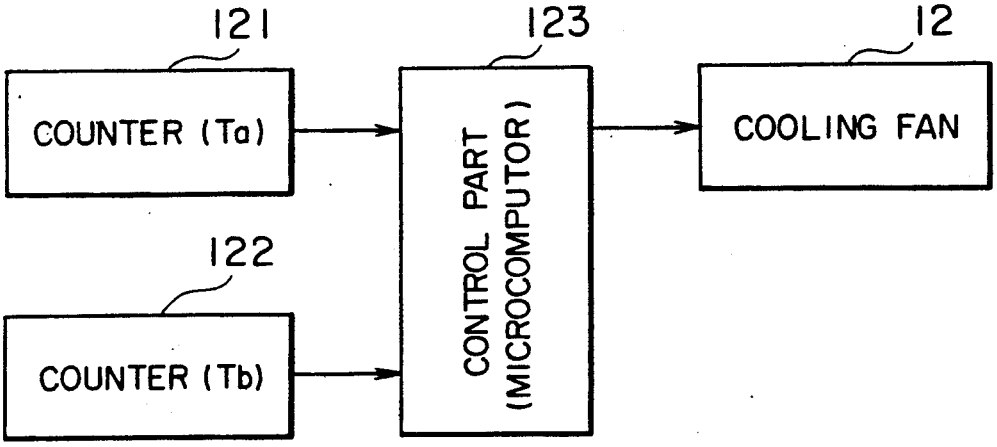
FIG. 4 is a block diagram for the cooling fan control circuit of another preferred embodiment of the image recording apparatus with cooling fan.
Figure 5:
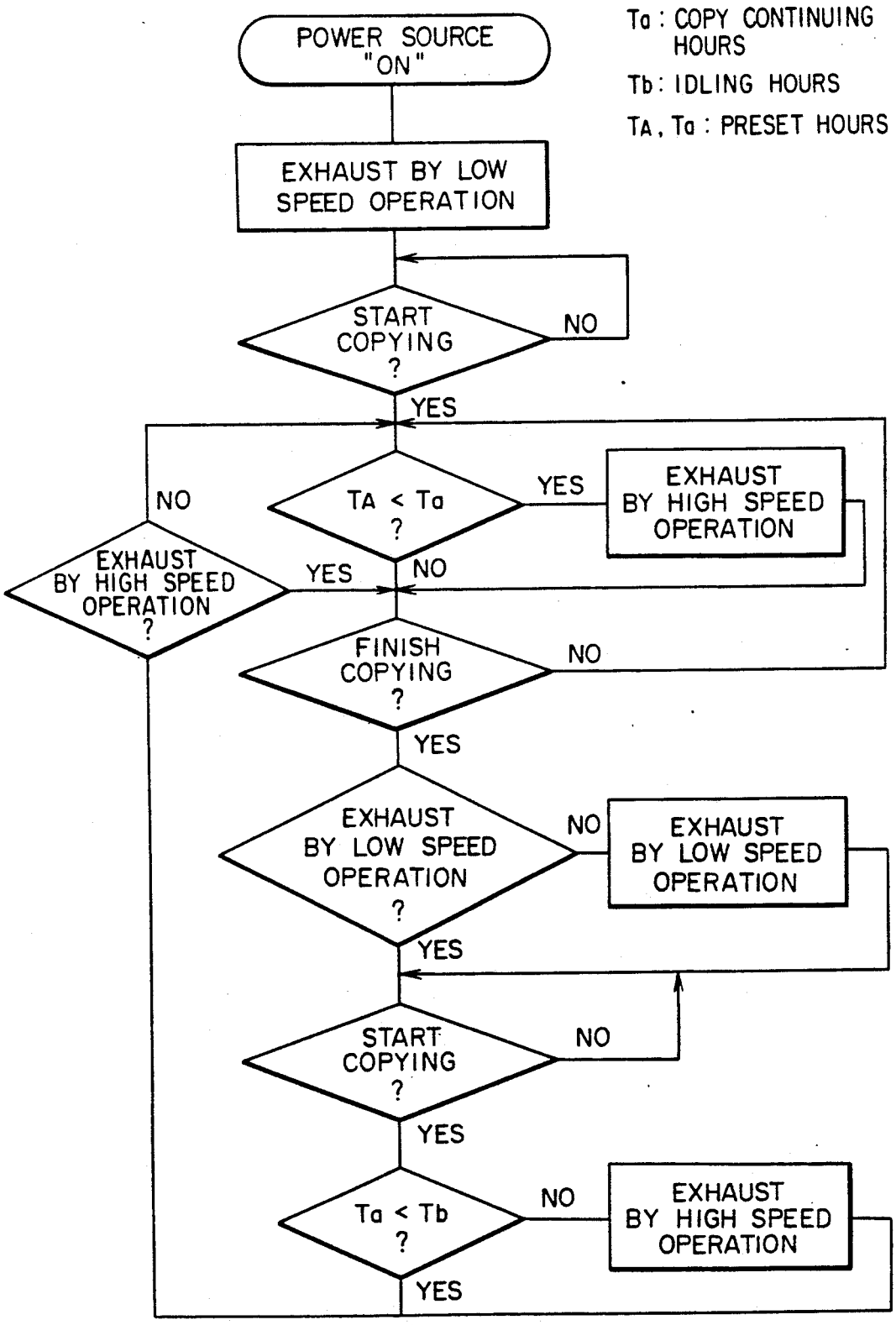
FIG. 5 is a flow chart of a program for controlling the cooling fan in FIG. 4.
Figure 6:
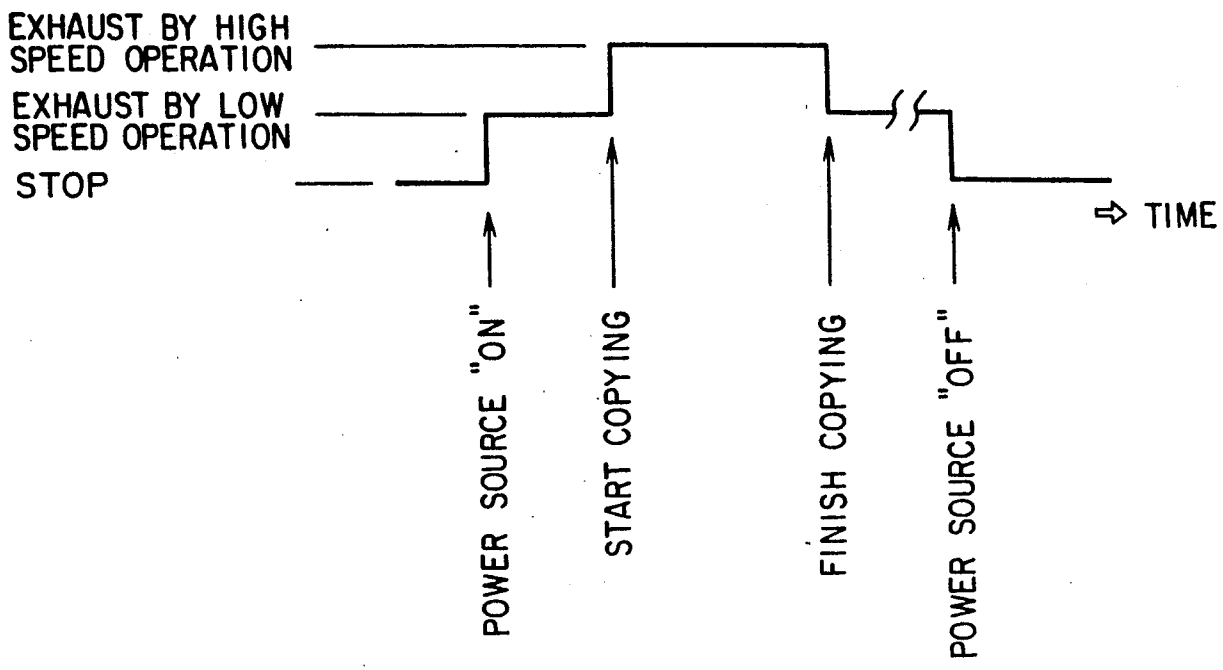
FIG. 6 is a timing chart for controlling a conventional cooling fan.

Another preferred embodiment of the present invention will be described below. FIG. 4 is a block diagram for a cooling fan of an embodiment of the present invention. FIG. 5 is a flow chart for a control program for the cooling fan 12. In the embodiment, there is provided a counter 121 which can count a copying time Ta. There is also provided a second counter 122 which can count an idling time Tb from end of preceding copying to start of present copying. The counted times Ta and Tb are fetched into a control circuit 123 comprising a microcomputer to control the cooling fan.

Referring now to FIG. 5, operation and control of the cooling fan 12 will be described below. First, with power on, the cooling fan 12 can start the low-speed exhaustion, and enters a normal idling operation. This can normally exhaust air from a recording unit enclosure. With the start of copying, the copying time Ta from the start is counted by the counter 121 until it exceeds a first preset reference time $T_A$. In this stage, the cooling fan 1 is at the low-speed exhaustion. When it exceeds $T_A$, it is switched to the high-speed exhaustion. This state continues until the end of copying. The above-mentioned first reference time $T_A$ can be preset in terms of a heat capacity of a thermal setting unit 11 in FIG. 3, an amount of low- or high-speed exhausted air of the cooling fan 12, a structure of the recording unit enclosure, and other factors. At the end of copying, the high-speed exhaustion state, if so, is switched over to the low-speed exhaustion state.

If copying is restarted after it has ended as described above, the cooling fan 12 is controlled depending on whether or not a time from end of the preceding copying to start of the present copying, or a time Tb counted by a counter 122, exceeds a second reference time $T_B$.

If Tb is grater than $T_B$, a long time elapsed from end of the preceding copying to start of the present copying. This can assume that cooling is fully made. The cooling fan 12, then, can be continued to operate at the low speed even when copying is restarted. This can make copying operation rather quiet. When the first reference time $T_A$ elapses from restart of copying, the cooling fan 12 is switched over to the high speed.

However, if Tb is not greater than $T_B$, The time from end of the preceding copying to restart of the present copying is too short to cool. The cooling fan 12, then, is operated at the high speed at the time of restart of copying. In this case, it is made to continue at the high speed until end of copying.

Figure 3:
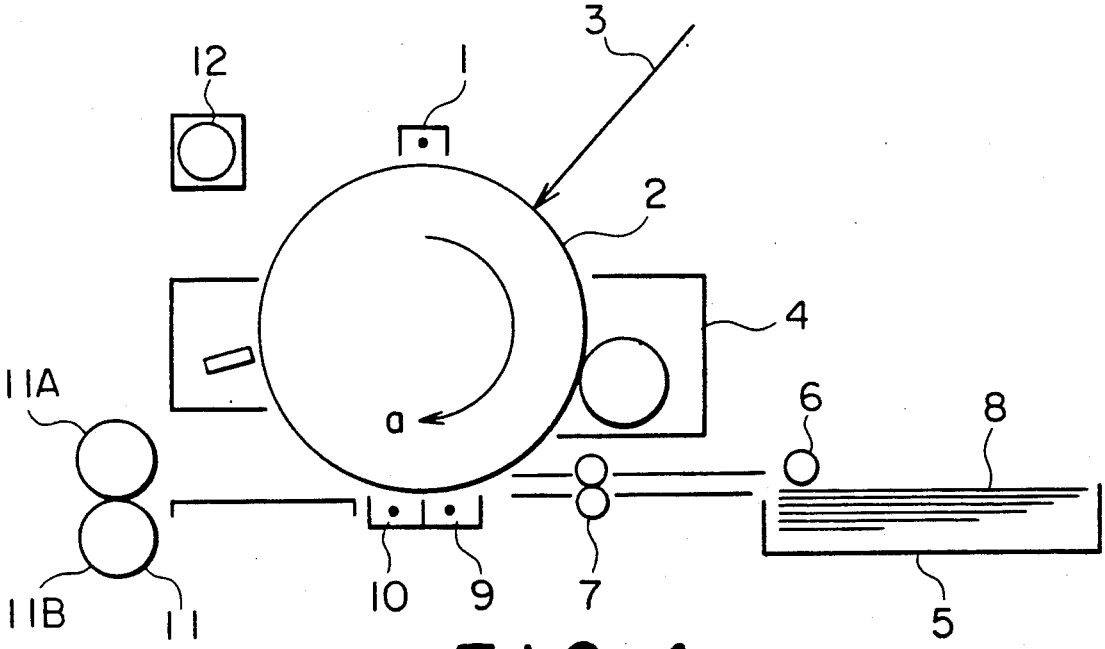
FIG. 3 is an illustration for the image recording apparatus.

The above-mentioned second reference time $T_B$, as for $T_A$, can be preset in terms of a heat capacity of a thermal setting unit 11 in FIG. 3, an amount of low- or high-speed exhausted air of the cooling fan 12, a structure of the recording unit enclosure, and other factors. At the end of copying, the high-speed exhaustion state, if so, is switched over to the low-speed exhaustion state.

What is claimed is:

1. An image recording apparatus comprising:

(a) an image recorder for forming a toner image and for transferring the toner image to a copy sheet;

(b) cooling fan for cooling said image recorder; and (c) a control for controlling said cooling fan during a copying operation cycle, said control having (1) a memory for storing a reference copying operation time of said image recorder, (2) a timer for obtaining an actual copying operation time of said image recorder, and (3) a comparitor for comparing said actual time with said reference time during said copying operation cycle, said control operating said cooling fan so that, when said comparitor determines that said actual time is longer than said reference time, said cooling fan is changed from low speed to high speed during said cycle.

* * * * *